US008783335B2

(12) United States Patent
Suzuki et al.

(10) Patent No.: US 8,783,335 B2
(45) Date of Patent: Jul. 22, 2014

(54) CONDENSER

(75) Inventors: Shingo Suzuki, Oyama (JP); Kazumi Tokizaki, Oyama (JP); Yoshihiko Seno, Oyama (JP); Takayuki Fujii, Oyama (JP)

(73) Assignee: Showa Denko K.K., Tokyo (JP)

( * ) Notice: Subject to any disclaimer, the term of this patent is extended or adjusted under 35 U.S.C. 154(b) by 700 days.

(21) Appl. No.: 13/064,699

(22) Filed: Apr. 11, 2011

(65) Prior Publication Data

US 2011/0253354 A1 Oct. 20, 2011

(30) Foreign Application Priority Data

Apr. 16, 2010 (JP) ..... 2010-094804
Mar. 8, 2011 (JP) ..... 2011-049913

(51) Int. Cl.
*F28D 7/16* (2006.01)
*F28F 19/00* (2006.01)

(52) U.S. Cl.
USPC ..... 165/176; 165/134.1

(58) Field of Classification Search
CPC .... F28F 19/002; F28D 1/0452; F28D 1/0443; F25B 47/003; F25B 39/04; F25B 43/04; F25B 40/02
USPC ..... 165/110, 173, 175, 176, 134.1; 62/507, 62/509
See application file for complete search history.

(56) References Cited

U.S. PATENT DOCUMENTS

| | | | | |
|---|---|---|---|---|
| 4,901,908 | A * | 2/1990 | Negura et al. | 228/183 |
| 4,936,379 | A * | 6/1990 | Hoshino et al. | 165/150 |
| 5,197,538 | A * | 3/1993 | Nagasaka et al. | 165/144 |
| 6,810,949 | B1 * | 11/2004 | Staffa et al. | 165/135 |
| 2006/0102328 | A1 * | 5/2006 | Toyama et al. | 165/133 |

FOREIGN PATENT DOCUMENTS

| | | | |
|---|---|---|---|
| JP | 60263098 | A * | 12/1985 |
| JP | 3-31266 | | 3/1991 |

* cited by examiner

*Primary Examiner* — Tho V Duong
(74) *Attorney, Agent, or Firm* — Edwards Wildman Palmer LLP

(57) ABSTRACT

A first header tank to which first heat exchange tubes of third and fourth heat exchange paths are connected and a second header tank to which second heat exchange tubes of first and second heat exchange paths are connected are provided at one end of a condenser. The upper end of the first header tank is located above the lower end of the second header tank. The first header tank has a function of separating gas and liquid and storing the liquid. The first heat exchange tubes have projecting portions at their ends located on the side toward the first header tank. A corrosion prevention member having a function of corroding sacrificially for the first heat exchange tubes is disposed in a clearance between the projecting portion of the upper-end first heat exchange tube and the lower end of the second header tank.

18 Claims, 8 Drawing Sheets

CONDENSER

CROSS REFERENCE TO RELATED APPLICATIONS

This application claims priority to Japanese Application Nos. 2010-094804 and 2011-049913, filed Apr. 16, 2010 and Mar. 8, 2011, respectively; each of the above-identified applications is incorporated by reference herein. This application is also related to co-pending applications, both entitled, "CONDENSER" filed concurrently herewith in the names of Shingo SUZUKI, Kazumi TOKIZAKI, Yoshihiko SENO and Takayuki FUJII, which claims priority to Japanese Application No. 2010-094800 and 2011-049912, filed Apr. 16, 2010 and Mar. 8, 2011, respectively, and which claims priority to Japanese Application No. 2010-096635 and 2011-059088, filed Apr. 20, 2010 and Mar. 17, 2011, respectively, each of which application is assigned to the assignee of the instant application and which co-pending application is also incorporated by reference herein.

BACKGROUND OF THE INVENTION

The present invention relates to a condenser suitable for use in, for example, a car air conditioner, which is a refrigeration cycle mounted on an automobile.

Herein and in the appended claims, the term "condenser" encompasses not only ordinary condensers but also sub-cool condensers each including a condensation section and a super-cooling section.

Further, herein and in the appended claims, the upper side, lower side, left-hand side, and right-hand side of FIGS. 1 and 2 will be referred to as "upper," "lower," "left," and "right," respectively.

A condenser for a car air conditioner is known (see Japanese Utility Model Application Laid-Open (kokai) No. H3-31266). The known condenser includes a plurality of flat heat exchange tubes which extend in a left-right direction and are disposed in parallel such that their width direction coincides with an air passage direction, and they are spaced apart from one another in a vertical direction; and header tanks which extend in the vertical direction and to which left and right end portions of the heat exchange tubes are connected, respectively. Three heat exchange paths each formed by a plurality of heat exchange tubes successively arranged in the vertical direction are provided such that the three heat exchange paths are juxtaposed in the vertical direction. Refrigerant flows in the same direction through all the heat exchange tubes which form each heat exchange path, and the flow direction of refrigerant flowing through the heat exchange tubes which form one of two adjacent heat exchange paths is opposite the flow direction of refrigerant flowing through the heat exchange tubes which form the other heat exchange path. A first header tank and a second header tank are individually provided at the left end or right end. The heat exchange tubes which form the heat exchange path at the lower end are connected to the first header tank. The heat exchange tubes which form the heat exchange paths other than the lower-end heat exchange path are connected to the second header tank. The second header tank is disposed above the first header tank. The thickness (diameter) of the first header tank is rendered considerably larger than that of the second header tank, and a desiccant is disposed within the first header tank. Thus, the first header tank functions as a liquid receiver which separates gas and liquid from each other by making use of gravitational force and stores the separated liquid. The first heat exchange tubes connected to the first header tank are equal in length to the second heat exchange tubes connected to the second header tank, and the ends of the first heat exchange tubes on the side toward the first header tank and the ends of the second heat exchange tubes on the side toward the second header tank are located on the same vertical line. All the heat exchange paths serve as refrigerant condensation paths for condensing refrigerant.

In the condenser disclosed in the publication, the internal volume of the first header tank must be rendered considerably large as compared with that of the second header tank, in order to effectively perform gas liquid separation within the first header tank. Therefore, the thickness of the first header tank is considerably large as compared with the second header tank, which raises a problem in that a large space is required for installing the condenser.

In general, other devices are disposed in the vicinity of a condenser. In the case of the condenser disclosed in the publication, the first header tank hinders installation of other devices. For example, a radiator is typically disposed downstream (with respect to an air passage direction) of a condenser for a car air conditioner. If the condenser disclosed in the publication is used, the first header tank hinders installation of the radiator. As a result, a wasteful space is produced within an engine compartment, which makes space saving difficult. In addition, since the heat exchange tubes are connected over substantially the entire length of the first header tank, the conventional condenser has a problem in that its gas liquid separation performance is not satisfactory.

SUMMARY OF THE INVENTION

An object of the present invention is to solve the above-mentioned problem and to provide a condenser which can reduce installation space as compared with the condenser disclosed in the above-mentioned publication, and which can improve the corrosion resistance of an upper-end first heat exchange tube located immediately below a second header tank.

To achieve the above object, the present invention comprises the following modes.

1) A condenser comprising a plurality of heat exchange tubes disposed in parallel such that the heat exchange tubes are spaced apart from one another in a vertical direction and extend in a left-right direction; header tanks which extend in the vertical direction and to which left and right end portions of the heat exchange tubes are connected; and fins each disposed between and brazed to heat exchange tubes adjacent to each other in the vertical direction, in which a plurality of heat exchange paths each formed by a plurality of heat exchange tubes successively arranged in the vertical direction are juxtaposed in the vertical direction, wherein first and second header tanks are provided at a left or right end of the condenser, first heat exchange tubes which form at least one heat exchange path located at a lower side being connected to the first header tank, and second heat exchange tubes which form a remaining heat exchange path(s) provided above the heat exchange path formed by the first heat exchange tubes connected to the first header tank being connected to the second header tank;

the first header tank is disposed on the outer side of the second header tank with respect to the left-right direction, has an upper end located above a lower end of the second header tank, and has a function of separating gas and liquid from each other and storing the liquid;

the first heat exchange tubes connected to the first header tank have projecting portions at their ends located on the side toward the first header tank, the projecting portions extending outward, with respect to the left-right direction, of second-header-tank-side end portions of the second heat exchange tubes connected to the second header tank; and a corrosion prevention member having a function of corroding sacrificially for the first heat exchange tubes is disposed in a clearance between the projecting portion of an upper-end first heat exchange tube and the lower end of the second header tank.

In the condenser of par. 1), the heat exchange tubes which form one heat exchange path may be connected to each of the first header tank and the second header tank.

2) A condenser comprising a plurality of heat exchange tubes disposed in parallel such that the heat exchange tubes are spaced apart from one another in a vertical direction and extend in a left-right direction; header tanks which extend in the vertical direction and to which left and right end portions of the heat exchange tubes are connected; and fins each disposed between and brazed to heat exchange tubes adjacent to each other in the vertical direction, in which three or more exchange paths each formed by a plurality of heat exchange tubes successively arranged in the vertical direction are juxtaposed in the vertical direction, wherein first and second header tanks are provided at a left or right end of the condenser, first heat exchange tubes which form at least two heat exchange paths successively arranged and including a heat exchange path at a lower end of the condenser being connected to the first header tank, and second heat exchange tubes which form a heat exchange path(s) provided above the heat exchange paths formed by the first heat exchange tubes connected to the first header tank being connected to the second header tank;

the first header tank is disposed on the outer side of the second header tank with respect to the left-right direction, has an upper end located above a lower end of the second header tank, and has a function of separating gas and liquid from each other and storing the liquid;

the first heat exchange tubes connected to the first header tank have projecting portions at their ends located on the side toward the first header tank, the projecting portions extending outward, with respect to the left-right direction, of second-header-tank-side end portions of the second heat exchange tubes connected to the second header tank; and a corrosion prevention member having a function of corroding sacrificially for the first heat exchange tubes is disposed in a clearance between the projecting portion of an upper-end first heat exchange tube and the lower end of the second header tank.

3) A condenser according to par. 2), wherein an upper-end heat exchange path of the heat exchange paths formed by the first heat exchange tubes connected to the first header tank and the heat exchange path(s) formed by the second heat exchange tubes connected to the second header each serve as a refrigerant condensation path for condensing refrigerant, and the heat exchange paths formed by the first heat exchange tubes connected to the first header tank, excluding the upper-end heat exchange path, each serves as a refrigerant supper-cooling path for supper-cooling refrigerant.

4) A condenser according to par. 2), wherein the first heat exchange tubes which form at least two heat exchange paths are connected to the first header tank, and the second heat exchange tubes which form at least one heat exchange path are connected to the second header tank.

5) A condenser comprising a plurality of heat exchange tubes disposed in parallel such that the heat exchange tubes are spaced apart from one another in a vertical direction and extend in a left-right direction; header tanks which extend in the vertical direction and to which left and right end portions of the heat exchange tubes are connected; and fins each disposed between and brazed to heat exchange tubes adjacent to each other in the vertical direction, in which two or more heat exchange paths each formed by a plurality of heat exchange tubes successively arranged in the vertical direction are juxtaposed in the vertical direction, wherein first and second header tanks are provided at a left or right end of the condenser, first heat exchange tubes which form a heat exchange path at a lower end of the condenser being connected to the first header tank, and second heat exchange tubes which form the heat exchange path(s) other than the heat exchange path at the lower end being connected to the second header tank;

the first header tank is disposed on the outer side of the second header tank with respect to the left-right direction, has an upper end located above a lower end of the second header tank, and has a function of separating gas and liquid from each other and storing the liquid;

the first heat exchange tubes connected to the first header tank have projecting portions at their ends located on the side toward the first header tank, the projecting portions extending outward, with respect to the left-right direction, of second-header-tank-side end portions of the second heat exchange tubes connected to the second header tank; and a corrosion prevention member having a function of corroding sacrificially for the first heat exchange tubes is disposed in a clearance between the projecting portion of the upper-end first heat exchange tube and the lower end of the second header tank.

6) A condenser comprising a plurality of heat exchange tubes disposed in parallel such that the heat exchange tubes are spaced apart from one another in a vertical direction and extend in a left-right direction; header tanks which extend in the vertical direction and to which left and right end portions of the heat exchange tubes are connected; and fins each disposed between and brazed to heat exchange tubes adjacent to each other in the vertical direction, in which two or more heat exchange paths each formed by a plurality of heat exchange tubes successively arranged in the vertical direction are juxtaposed in the vertical direction, wherein first and second header tanks are provided at a left or right end of the condenser, first heat exchange tubes which form a heat exchange path at an upper end of the condenser being connected to the first header tank, and second heat exchange tubes which form the heat exchange path(s) other than the heat exchange path at the upper end being connected to the second header tank;

the first header tank is disposed on the outer side of the second header tank with respect to the left-right direction, has a lower end located below an upper end of the second header tank, and has a function of separating gas and liquid from each other and storing the liquid;

the first heat exchange tubes connected to the first header tank have projecting portions at their ends located on the side toward the first header tank, the projecting portions extending outward, with respect to the left-right direction, of second-header-tank-side end portions of the second heat exchange tubes connected to the second header tank; and a corrosion prevention member having a function of corroding sacrificially for the first heat exchange tubes is disposed in a clearance between the projecting portion of the lower-end first heat exchange tube and the upper end of the second header tank.

7) A condenser according to par. 5) or 6), wherein each of all the heat exchange paths serves as a refrigerant condensation path for condensing refrigerant.

8) A condenser according to par. 1), 2), 5), or 6), wherein the corrosion prevention member is a corrugated member which has crest portions extending in an air passage direction, trough portions extending in the air passage direction, and connection portions connecting the crest portions and the trough portions.

9) A condenser according to par. 8), wherein the corrosion prevention member is integrally provided on a fin disposed between the upper-end first heat exchange tube and a second heat exchange tube adjacent to and located above the upper-end first heat exchange tube.

10) A condenser according to par. 1), 2), 5), or 6), wherein the corrosion prevention member is formed by means of bending a single plate, and has a space portion which extends in an air passage direction and whose opposite ends are opened.

11) A condenser according to par. 1), 2), 5), or 6), wherein the corrosion prevention member is a generally V-shaped plate spring which includes an arcuate portion and arm portions extending from upper and lower ends of the arcuate portion, and the corrosion prevention member is disposed in a clearance between the projecting portion of the upper-end first heat exchange tube and the lower end of the second header tank in a state in which the corrosion prevention member is elastically deformed such that the two arm portions approach each other.

12) A condenser according to par. 11), wherein the lower arm portion of the corrosion prevention member has an engagement portion which comes into engagement with an upstream or downstream side edge portion of the upper-end first heat exchange tube.

13) A condenser according to par. 11), wherein a recess is formed on a lower end surface of the second header tank, and a projection which fits into the recess is provided on the upper arm portion of the corrosion prevention member.

According to the condenser of par. 1), first and second header tanks are provided at the left or right end of the condenser. First heat exchange tubes which form at least two heat exchange paths successively arranged and including a heat exchange path at the lower end are connected to the first header tank, and second heat exchange tubes which form a heat exchange path(s) provided above the heat exchange paths formed by the first heat exchange tubes connected to the first header tank are connected to the second header tank. The first header tank is disposed on the outer side of the second header tank with respect to the left-right direction, has an upper end located above a lower end of the second header tank, and has a function of separating gas and liquid from each other and storing the liquid. Therefore, as compared with the condenser disclosed in the above-mentioned publication, the internal volume of the first header tank can be increased so as to effectively perform gas liquid separation, for example, by extending the upper end of the first header tank upward to the vicinity of the upper end of the second header tank, without making the thickness of the first header tank greater than that of the second header tank. Accordingly, a space for installing the condenser can be made smaller as compared with the condenser disclosed in the above-mentioned publication. As a result, space saving becomes possible. In addition, since a relatively large space is present above a portion of the first header tank to which heat exchange tubes are connected, the gas liquid separation action by gravitational force becomes excellent.

According to the condenser of par. 2), first and second header tanks are provided at the left or right end of the condenser. First heat exchange tubes which form at least two heat exchange paths successively arranged and including a heat exchange path at the lower end are connected to the first header tank, and second heat exchange tubes which form a heat exchange path(s) provided above the heat exchange paths formed by the first heat exchange tubes connected to the first header tank are connected to the second header tank. The first header tank is disposed on the outer side of the second header tank with respect to the left-right direction, has an upper end located above a lower end of the second header tank, and has a function of separating gas and liquid from each other and storing the liquid. Therefore, as compared with the condenser disclosed in the above-mentioned publication, the internal volume of the first header tank can be increased so as to effectively perform gas liquid separation, for example, by extending the upper end of the first header tank upward to the vicinity of the upper end of the second header tank, without making the thickness of the first header tank greater than that of the second header tank. Accordingly, a space for installing the condenser can be made smaller as compared with the condenser disclosed in the above-mentioned publication. As a result, space saving becomes possible. In addition, since a relatively large space is present above a portion of the first header tank to which heat exchange tubes are connected, the gas liquid separation action by gravitational force becomes excellent.

According to the condensers of pars. 1) to 4), the first heat exchange tubes connected to the first header tank have projecting portions at their ends located on the side toward the first header tank, the projecting portions extending outward, with respect to the left-right direction, of second-header-tank-side end portions of the second heat exchange tubes connected to the second header tank; and a corrosion prevention member having a function of corroding sacrificially for the first heat exchange tubes is disposed in a clearance between the projecting portion of the upper-end first heat exchange tube and the lower end of the second header tank. Therefore, it is possible to prevent occurrence of pitting corrosion of the upper-end first heat exchange tube among all the first heat exchange tubes connected to the first header tank, to thereby prevent leakage of refrigerant which would otherwise occur due to the pitting corrosion.

That, is, in general, occurrence of pitting corrosion of heat exchange tubes of a condenser and leakage of refrigerant caused by the pitting corrosion are prevented by means of forming a sacrificial corrosion layer of zinc or the like on the outer circumferential surface of each heat exchange tube or forming fins from a material which corrodes sacrificially for the core portions of the heat exchange tubes excluding sacrificial corrosion layers thereof. However, occurrence of pitting corrosion and leakage of refrigerant caused by the pitting corrosion may occur in a condenser in which first and second header tanks are provided at a left or right end of the condenser, first heat exchange tubes which form at least two heat exchange paths successively arranged and including a heat exchange path at a lower end of the condenser being connected to the first header tank, and second heat exchange tubes which form a heat exchange path(s) provided above the heat exchange paths formed by the first heat exchange tubes connected to the first header tank being connected to the second header tank; and the first header tank is disposed on the outer side of the second header tank with respect to the left-right direction, and has an upper end located above a lower end of the second header tank. In such a condenser, if the first heat exchange tubes connected to the first header tank have projecting portions at their ends located on the side toward the first header tank, the projecting portions extending outward, with respect to the left-right direction, of second-header-tank-side end portions of the second heat exchange tubes connected to the second header tank, a clearance is formed between the lower end of the second header tank and the first-header-tank-side projecting portion of the upper-end first heat exchange tube among all the first heat exchange tubes connected to the first header tanks. In such a case, since the clearance is relatively large and no fin is present in the clearance, a relatively large amount of a substance which accelerates corrosion of the heat exchange tubes may accumulate in the clearance. Because of this corrosion accelerating substance, pitting corrosion may occur in the upper-end first heat exchange tube among all the first heat exchange tubes, and cause leakage of refrigerant.

In contrast, in the case where a corrosion prevention member having a function of corroding sacrificially for the first heat exchange tubes is disposed in the clearance between the upper-end first heat exchange tube and the lower end of the second header tank, the corrosion prevention corrodes while sacrificing itself for the upper-end first heat exchange tube. Thus, it is possible to prevent occurrence of pitting corrosion of the upper-end first heat exchange tube and leakage of refrigerant from the upper-end first heat exchange tube.

According to the condenser of par. 3), refrigerant flows into the first header tank from a plurality of first heat exchange tubes which form the refrigerant condensation path located at the lower end, and gas liquid separation is performed within the first header tank. Therefore, it is possible to suppress a drop in pressure, to thereby prevent re-vaporization of liquid-phase refrigerant.

Further, according to the condenser of par. 3), refrigerant flows into the first header tank from a plurality of heat exchange tubes which form the refrigerant condensation path located at the lower end, and gas liquid separation is performed within the first header tank. Therefore, the gas liquid separation can be performed efficiently within the first header tank. That is, gas-liquid mixed phase refrigerant whose gas phase component is large in amount flows through upper-side first heat exchange tubes among a plurality of first heat exchange tubes which form a refrigerant condensation path, and gas-liquid mixed phase refrigerant whose liquid phase component is large in amount flows through lower-side first heat exchange tubes among the plurality of first heat exchange tubes. Since these gas-liquid mixed phase refrigerants flow into the first header tank without mixing, gas liquid separation can be performed efficiently.

According to the condenser of par. 5), first and second header tanks are provided at a left or right end of the condenser, first heat exchange tubes which form a heat exchange path at a lower end of the condenser being connected to the first header tank, and second heat exchange tubes which form the heat exchange path(s) other than the lower-end heat exchange path being connected to the second header tank; and the first header tank is disposed on the outer side of the second header tank with respect to the left-right direction, has an upper end located above a lower end of the second header tank, and has a function of separating gas and liquid from each other and storing the liquid. Therefore, as compared with the condenser disclosed in the above-mentioned publication, the internal volume of the first header tank can be increased so as to effectively perform gas liquid separation, for example, by extending the upper end of the first header tank upward to the vicinity of the upper end of the second header tank, without making the thickness of the first header tank greater than that of the second header tank. Accordingly, a space for installing the condenser can be made smaller as compared with the condenser disclosed in the above-mentioned publication. In addition, since a relatively large space is present above a portion of the first header tank to which heat exchange tubes are connected, the gas liquid separation action by gravitational force becomes excellent.

Further, refrigerant flows into the first header tank from a plurality of first heat exchange tubes which form the refrigerant condensation path located at the lower end, and gas liquid separation is performed within the first header tank. Therefore, the gas liquid separation can be performed efficiently within the first header tank. That is, gas-liquid mixed phase refrigerant whose gas phase component is large in amount flows through upper-side heat exchange tubes among a plurality of first heat exchange tubes which form the lower-end heat exchange path, and gas-liquid mixed phase refrigerant whose liquid phase component is large in amount flows through lower-side heat exchange tubes among the plurality of first heat exchange tubes. Since these gas-liquid mixed phase refrigerants flow into the first header tank without mixing, gas liquid separation can be performed efficiently.

Furthermore, the first heat exchange tubes connected to the first header tank have projecting portions at their ends located on the side toward the first header tank, the projecting portions extending outward, with respect to the left-right direction, of second-header-tank-side end portions of the second heat exchange tubes connected to the second header tank; and a corrosion prevention member having a function of corroding sacrificially for the first heat exchange tubes is disposed in a clearance between the upper-end first heat exchange tube and the lower end of the second header tank. Therefore, as in the case of the condensers according to pars. 1) and 2), occurrence of pitting corrosion of the upper-end first heat exchange tube among all the first heat exchange tubes connected to the first header tank, and leakage of refrigerant caused by the pitting corrosion can be prevented.

According to the condenser of par. 6), first and second header tanks are provided at a left or right end of the condenser, first heat exchange tubes which form a heat exchange path at an upper end of the condenser being connected to the first header tank, and second heat exchange tubes which form the remaining heat exchange path(s) being connected to the second header tank; the first header tank is disposed on the outer side of the second header tank with respect to the left-right direction, has a lower end located below an upper end of the second header tank, and has a function of separating gas and liquid from each other and storing the liquid. Therefore, as compared with the condenser disclosed in the above-mentioned publication, the internal volume of the first header tank can be increased so as to effectively perform gas liquid separation, for example, by extending the lower end of the first header tank downward to the vicinity of the lower end of the second header tank, without making the thickness of the first header tank greater than that of the second header tank. Accordingly, a space for installing the condenser can be made smaller as compared with the condenser disclosed in the above-mentioned publication.

Further, refrigerant flows into the first header tank from a plurality of heat exchange tubes which form the refrigerant condensation path located at the upper end, and gas liquid separation is performed within the first header tank. Therefore, the gas liquid separation can be performed efficiently within the first header tank. That is, gas-liquid mixed phase refrigerant whose gas phase component is large in amount flows through upper-side first heat exchange tubes among a plurality of first heat exchange tubes which form the upper-end heat exchange path, and gas-liquid mixed phase refrigerant whose liquid phase component is large in amount flows through lower-side first heat exchange tubes among the plurality of first heat exchange tubes. Since these gas-liquid mixed phase refrigerants flow into the first header tank without mixing, gas liquid separation can be performed efficiently.

Furthermore, the first heat exchange tubes connected to the first header tank have projecting portions at their ends located on the side toward the first header tank, the projecting portions extending outward, with respect to the left-right direction, of second-header-tank-side end portions of the second heat exchange tubes connected to the second header tank; and a corrosion prevention member having a function of corroding sacrificially for the first heat exchange tubes is disposed in a clearance between the lower-end first heat exchange tube and the upper end of the second header tank. Therefore, as in the case of the condensers according to pars. 1) and 2), occurrence of pitting corrosion of the lower-end first heat exchange tube among all the first heat exchange tubes connected to the first header tank, and leakage of refrigerant caused by the pitting corrosion can be prevented.

According to the condenser of par. 8), the corrosion prevention member is a corrugated member which has crest portions extending in the air passage direction, trough portions extending in the air passage direction, and connection portions connecting the crest portions and the trough portions. Therefore, at the time of manufacture of the condenser, the corrosion prevention member can be disposed between the projecting portion of the first heat exchange tube and the second header tank such that the corrosion prevention member is compressed slightly in the vertical direction, whereby coming off of the corrosion prevention member is prevented during brazing in a furnace.

According to the condenser of par. 9), the number of components decreases, and, at the time of manufacture of the condenser, the work of disposing the corrosion prevention member between the projecting portion of the first heat exchange tube and the second header tank can be performed relatively simply.

According to the condenser of par. 10), the corrosion prevention member is formed by means of bending a single plate, and has a space portion which extends in the air passage direction and whose opposite ends are opened. Therefore, at the time of manufacture of the condenser, the corrosion prevention member can be disposed between the projecting portion of the first heat exchange tube and the second header tank such that the corrosion prevention member is compressed slightly in the vertical direction, whereby coming off of the corrosion prevention member is prevented during brazing in a furnace.

According to the condenser of par. 11), the following effect is attained. That is, at the time of manufacture of the condenser, which is manufactured by brazing all the components together, the corrosion prevention member, which is a generally V-shaped plate spring, is disposed in a clearance between the projecting portion of the upper-end first heat exchange tube and the lower end of the second header tank in a state in which the corrosion prevention member is elastically deformed such that the two arm portions approach each other. Therefore, it is possible to prevent coming off of the corrosion prevention member which would otherwise occur at the time of brazing in a furnace during the manufacture of the condenser.

According to the condenser of par. 12), positioning of the corrosion prevention member in relation to the first heat exchange tube can be performed when components which constitute the condenser are assembled before brazing.

According to the condenser of par. 13), positioning of the corrosion prevention member in relation to the second header tank can be performed, and coming off of the corrosion prevention member, which would otherwise occur at the time of brazing in a furnace during the manufacture of the condenser, can be prevented effectively.

DESCRIPTION OF THE PREFERRED EMBODIMENTS

Embodiments of the present invention will next be described with reference to the drawings.

Figure 1:
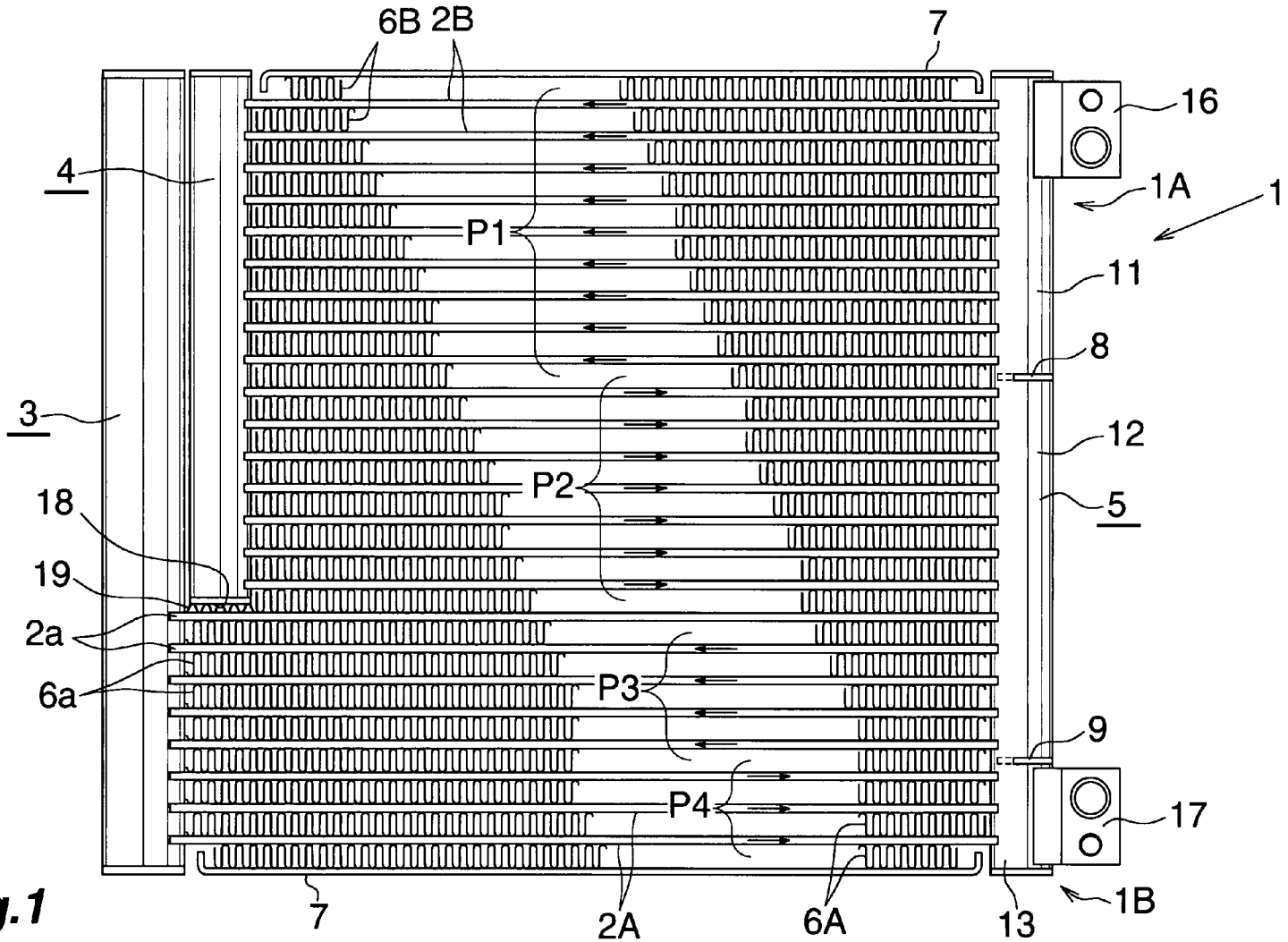
FIG. 1 is a front view specifically showing the overall structure of a first embodiment of the condenser according to the present invention.

In the following description, the downstream side with respect to an air passage direction (the reverse side of a sheet on which FIG. 1 is drawn) will be referred to as the "front," and the opposite side as the "rear."

Furthermore, the term "aluminum" as used in the following description encompasses aluminum alloys in addition to pure aluminum.

Moreover, the same reference numerals are used throughout the drawings to refer to the same portions and members, and their repeated descriptions are omitted.

Figure 2:
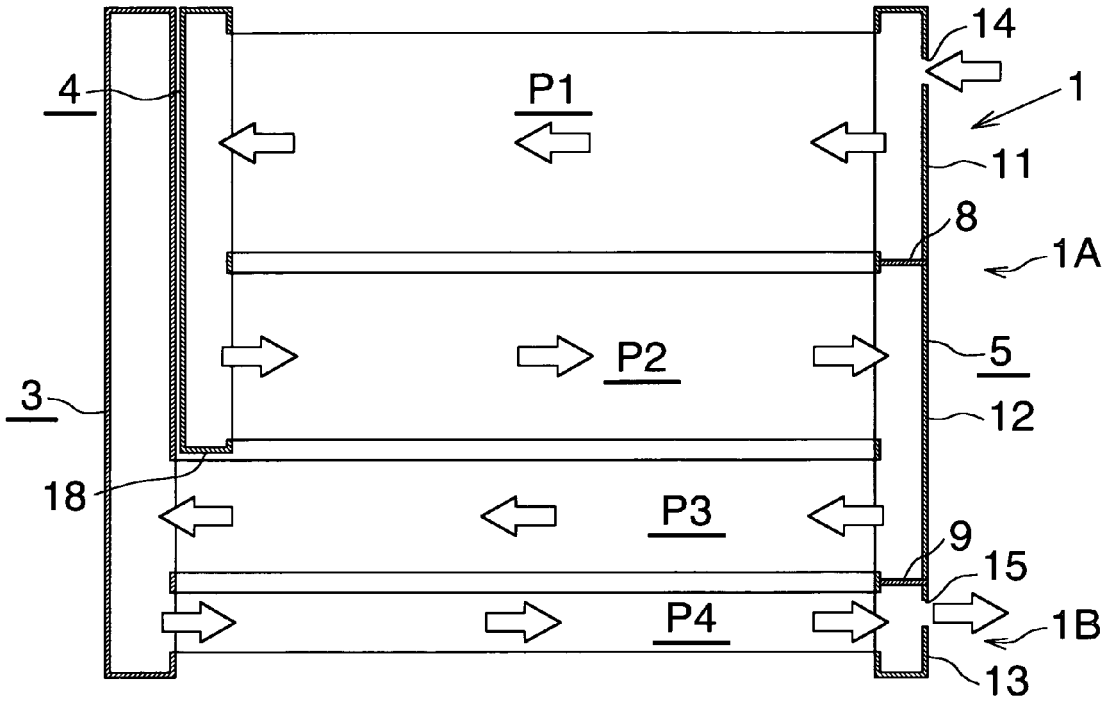
FIG. 2 is a front view schematically showing the condenser of FIG. 1.
Figure 3:
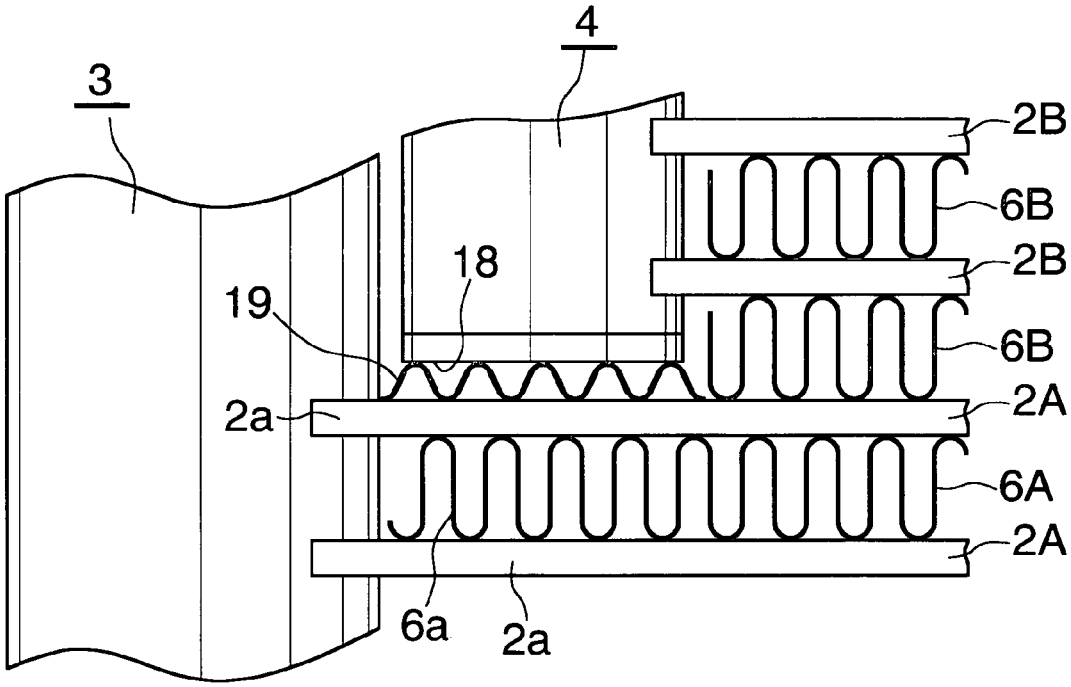
FIG. 3 is a partial enlarged view of FIG. 1.
Figure 4:
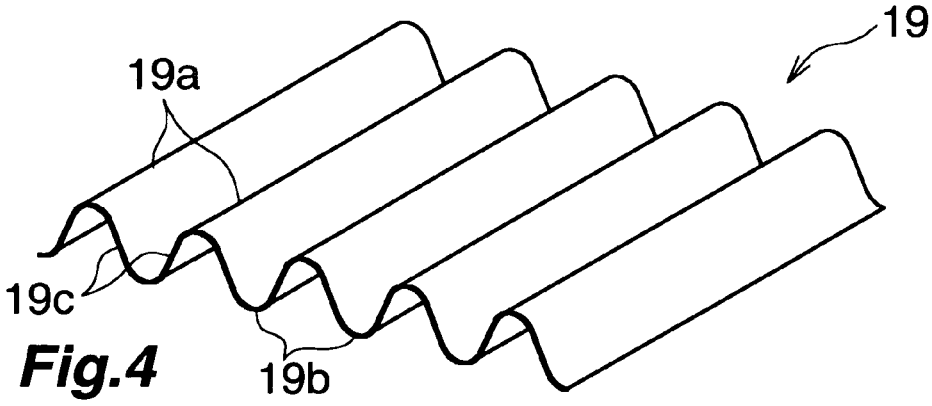
FIG. 4 is a perspective view showing a corrosion prevention member used in the condenser of FIG. 1.

FIG. 1 specifically shows the overall structure of a condenser according to the present invention; and FIG. 2 schematically shows the condenser according to the present invention. In FIG. 2, individual heat exchange tubes are omitted, and corrugate fins, side plates, a refrigerant inlet member, and a refrigerant outlet member are also omitted. FIGS. 3 and 4 show the structure of a main portion of the condenser of FIG. 1.

In FIGS. 1 and 2, a condenser 1 includes a plurality of flat heat exchange tubes 2A, 2B formed of aluminum, three header tanks 3, 4, 5 formed of aluminum, corrugate fins 6A, 6B formed of aluminum, and side plates 7 formed of aluminum. The heat exchange tubes 2A, 2B are disposed such that their width direction coincides with a front-rear direction, their length direction coincides with a left-right direction, and they are spaced from one another in a vertical direction. Left and right end portions of the heat exchange tubes 2A, 2B are connected, by means of brazing, to the header tanks 3, 4, 5, which extend in the vertical direction. Each of the corrugate fins 6A, 6B is disposed between and brazed to adjacent heat exchange tubes 2A, 2B, or is disposed on the outer side of the uppermost or lowermost heat exchange tube 2A, 2B and brazed to the corresponding heat exchange tube 2A, 2B. The side plates 7 are disposed on the corresponding outer sides of the uppermost and lowermost corrugate fins 6A, 6B, and are brazed to these corrugate fins 6A, 6B. Three or more heat exchange paths (in the present embodiment, four heat exchange paths P1, P2, P3, P4) each formed by a plurality of heat exchange tubes 2A, 2B successively arranged in the vertical direction are juxtaposed in the vertical direction. The four heat exchange paths will be referred to as the first to fourth heat exchange paths P1, P2, P3, P4 from the upper side. The flow direction of refrigerant is the same among all the heat exchange tubes 2A, 2B which form the respective heat exchange paths P1, P2, P3, P4. The flow direction of refrigerant in the heat exchange tubes 2A, 2B which form a certain heat exchange path is opposite the flow direction of refrigerant in the heat exchange tubes 2A, 2B which form another heat exchange path adjacent to the certain heat exchange path.

A first header tank 3 and a second header tank 4 are individually provided at the left end of the condenser 1. The heat exchange tubes 2A, which form at least two heat exchange paths which are successively arranged and which include a heat exchange path at the lower end (in the present embodiment, the third and fourth heat exchange paths P3, P4), are connected to the first header tank 3 by means of brazing. The heat exchange tubes 2B, which form the first and second heat exchange paths P1, P2, are connected to the second header tank 4 by means of brazing. The heat exchange tubes 2A connected to the first header tank 3 will be referred to as the first heat exchange tubes, and the heat exchange tubes 2B connected to the second header tank 4 will be referred to as the second heat exchange tubes. A sacrificial corrosion layer formed of zinc or the like is formed on the outer circumferential surfaces of the first and second heat exchange tubes 2A, 2B. The corrugate fins 6A disposed between the adjacent first heat exchange tubes 2A and between the lower-end first heat exchange tube 2A and the lower side plate 7 will be referred to as the first corrugate fins. The corrugate fins 6B disposed between the adjacent second heat exchange tubes 2B, between the upper-end first heat exchange tube 2A and the lower-end second heat exchange tube 2B, and between the upper-end second heat exchange tube 2B and the upper side plate 7 will be referred to as the second corrugate fins. The first and second corrugate fins 6A, 6B are formed of a material which sacrificially corrodes for the sake of the core portions of the first and second heat exchange tubes 2A, 2B, excluding the sacrificial corrosion layers thereof.

Although the first header tank 3 and the second header tank 4 are approximately equal to each other in terms of the dimension along the front-rear direction, the first header tank 3 is greater than the second header tank 4 in terms of the horizontal cross sectional area. The first header tank 3 is disposed on the left side (on the outer side with respect to the left-right direction) of the second header tank 4. The center of the first header tank 3 with respect to the left-right direction is located on the outer side (with respect to the left-right direction) of the center of the second header tank 4 with respect to the left-right direction. Therefore, the first header tank 3 and the second header tank 4 are offset from each other such that they do not overlap as viewed from above. The upper end of the first header tank 3 is located above the lower end of the second header tank 4. In the present embodiment, the upper end of the first header tank 3 is located at a position which is substantially the same height as the upper end of the second header tank 4. Thus, the first header tank 3 serves as a liquid receiver which separates gas and liquid from each other through utilization of gravitational force, and stores the separated liquid. That is, the internal volume of the first header tank 3 is determined such that a portion of gas-liquid mixed phase refrigerant having flowed into the first header tank 3; i.e., liquid-predominant mixed phase refrigerant, remains in a lower region within the first header tank 3 because of gravitational force, and the gas phase component of the gas-liquid mixed phase refrigerant remains in an upper region within the first header tank 3 because of gravitational force, whereby only the liquid-predominant mixed phase refrigerant flows into the first heat exchange tubes 2A of the fourth heat exchange path P4.

The third header tank 5 is disposed at the right end of the condenser 1, and all the heat exchange tubes 2A, 2B which form the first to fourth heat exchange paths P1-P4 are connected to the third header tank 5. The transverse cross sectional shape of the third header tank 5 is identical with that of the second header tank 4. The interior of the third header tank 5 is divided into an upper header section 11, an intermediate header section 12, and a lower header section 13 by aluminum partition plates 8, 9, which are provided at a height between the first heat exchange path P1 and the second heat exchange path P2 and a height between the third heat exchange path P3 and the fourth heat exchange path P4, respectively. Left end portions of the second heat exchange tubes 2B of the first heat exchange path P1 are connected to the second header tank 4, and right end portions thereof are connected to the upper header section 11 of the third header tank 5. Left end portions of the second heat exchange tubes 2B of the second heat exchange path P2 are connected to the second header tank 4, and right end portions thereof are connected to the intermediate header section 12 of the third header tank 5. Left end portions of the first heat exchange tubes 2A of the third heat exchange path P3 are connected to the first header tank 3, and right end portions thereof are connected to the intermediate header section 12 of the third header tank 5. Left end portions of the first heat exchange tubes 2A of the fourth heat exchange path P4 are connected to the first header tank 3, and right end portions thereof are connected to the lower header section 13 of the third header tank 5.

The second header tank 4, a portion of the first header tank 3 to which the first heat exchange tubes 2A of the third heat exchange path P3 are connected, the upper and intermediate header sections 11 and 12 of the third header tank 5, and the first to third heat exchange paths P1-P3 form a condensation section 1A, which condenses refrigerant. A portion of the first header tank 3 to which the first heat exchange tubes 2A of the fourth heat exchange path P4 are connected, the lower header section 13 of the third header tank 5, and the fourth heat exchange path P4 form a super-cooling section 1B, which super-cools refrigerant. Each of the first to third heat exchange paths P1-P3 serves as a refrigerant condensation path for condensing refrigerant, and the fourth heat exchange path P4 serves as a refrigerant super-cooling path for super-cooling refrigerant.

A refrigerant inlet 14 is formed at the upper header section 11 of the third header tank 5, which partially forms the condensation section 1A, and a refrigerant outlet 15 is formed at the lower header section 13 of the third header tank 5, which partially forms the super-cooling section 1B. A refrigerant inlet member 16 which communicates with the refrigerant inlet 14 and a refrigerant outlet member 17 which communicates with the refrigerant outlet 15 are joined to the third header tank 5.

As shown in FIG. 3, at left end portions (end portions on the side toward the first header tank 3) of the first heat exchange tubes 2A connected to the first header tank 3, projecting portions 2*a* are provided such that the projecting portions 2*a* extend leftward beyond left end portions (end portions on the side toward the second header tank 4) of the second heat exchange tubes 2B connected to the second header tank 4. A clearance 18 is present between the lower end of the second header tank 4 and the projecting portion 2*a* of the upend-end first heat exchange tube 2A among all the first heat exchange tubes 2A. Furthermore, at left end portions of the first corrugate fins 6A, there are provided projecting portions 6*a* which project leftward beyond the left end portions of the second corrugate fins 6B. The projecting portions 6*a* of the first corrugate fins 6A are disposed between the projecting portions 2*a* of the adjacent first heat exchange tubes 2A, and are brazed to the projecting portions 2*a*.

A corrosion prevention member 19 having a function of sacrificially corroding for the sake of the first heat exchange tubes 2A is disposed in the clearance 18 between the lower end of the second header tank 4 and the projecting portion 2*a* of the upend-end first heat exchange tube 2A among all the first heat exchange tubes 2A. As shown in FIG. 4, the corrosion prevention member 19 is a corrugated member having crest portions 19*a* extending in the air passage direction, trough portions 19*b* extending in the air passage direction, and connection portions 19*c* connecting the crest portions 19*a* and the trough portions 19*b*. The corrosion prevention member 19 is formed of a material having a function of sacrificially corroding for the sake of the first heat exchange tubes 2A; in the present embodiment, a material which corrodes sacrificially for the core portions of the first heat exchange tubes 2A, excluding the corrosion prevention layers thereof. The crest portions 19*a* and the trough portions 19*b* of the corrosion prevention member 19 are rounded. The crest portions 19*a* are brazed to the lower end of the second header tank 4, and the trough portions 19*b* are brazed to the projecting portion 2*a* of the upper-end first heat exchange tube 2A.

The condenser 1 is manufactured by brazing all the components together. At the time of manufacture of the condenser 1, the corrosion prevention member 19 is disposed between the projecting portion 2*a* of the upper-end first heat exchange tube 2A and the lower end of the second header tank 4 such that the corrosion prevention member 19 is compressed slightly in the vertical direction, whereby coming off of the corrosion prevention member 19 is prevented during brazing in a furnace.

The condenser 1 constitutes a refrigeration cycle in cooperation with a compressor, an expansion valve (pressure reducer), and an evaporator; and the refrigeration cycle is mounted on a vehicle as a car air conditioner.

In the condenser 1 having the above-described structure, gas phase refrigerant of high temperature and high pressure compressed by the compressor flows into the upper header section 11 of the third header tank 5 via the refrigerant inlet member 16 and the refrigerant inlet 14. The gas phase refrigerant is condensed while flowing leftward within the second heat exchange tubes 2B of the first heat exchange path P1, and then flows into the second header tank 4. The refrigerant having flowed into the second header tank 4 is condensed while flowing rightward within the second heat exchange tubes 2B of the second heat exchange path P2, and then flows into the intermediate header section 12 of the third header tank 5. The refrigerant having flowed into the intermediate header section 12 of the third header tank 5 is condensed while flowing leftward within the first heat exchange tubes 2A of the third heat exchange path P3, and then flows into the first header tank 3.

The refrigerant having flowed into the first header tank 3 is gas-liquid mixed phase refrigerant. A portion of the gas-liquid mixed phase refrigerant; i.e., liquid-predominant mixed phase refrigerant, remains in a lower region within the first header tank 3 because of gravitational force, and enters the first heat exchange tubes 2A of the fourth heat exchange path P4.

The liquid-predominant mixed phase refrigerant having entered the first heat exchange tubes 2A of the fourth heat exchange path P4 is super-cooled while flowing rightward within the first heat exchange tubes 2A. After that, the super-cooled refrigerant enters the lower header section 13 of the third header tank 5, and flows out via the refrigerant outlet 15 and the refrigerant outlet member 17. The refrigerant is then fed to the evaporator via the expansion valve.

Meanwhile, the gas phase component of the gas-liquid mixed phase refrigerant having flowed into the first header tank 3 remains in an upper region within the first header tank 3.

FIGS. 5 to 12 show modifications of the corrosion prevention member.

Figure 5:
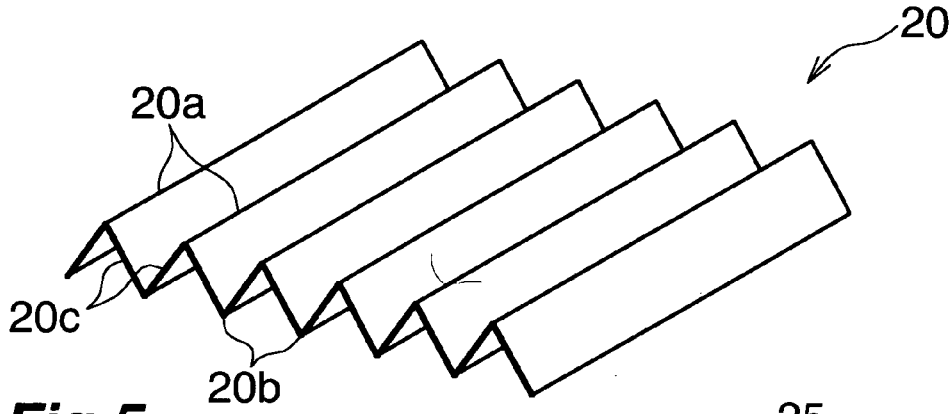
FIG. 5 is a perspective view showing a first modification of the corrosion prevention member.

A corrosion prevention member 20 shown in FIG. 5 is a corrugated member having crest portions 20*a* extending in the air passage direction, trough portions 20*b* extending in the air passage direction, and connection portions 20*c* connecting the crest portions 20*a* and the trough portions 20*b*. The corrosion prevention member 20 is formed of a material having a function of sacrificially corroding for the sake of the first heat exchange tubes 2A. The crest portions 20*a* of the corrosion prevention member 20 are pointed upward, and the trough portions 20*b* of the corrosion prevention member 20 are pointed downward. The crest portions 20*a* are brazed to the lower end of the second header tank 4, and the trough portions 20*b* are brazed to the projecting portion 2*a* of the upper-end first heat exchange tube 2A.

Figure 6:
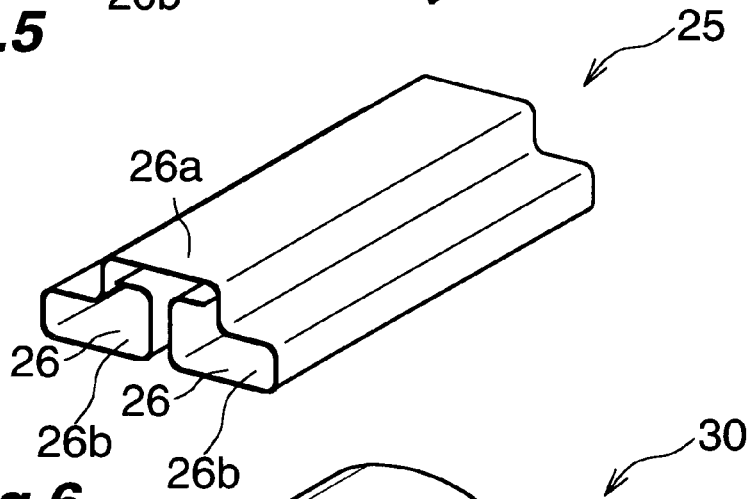
FIG. 6 is a perspective view showing a second modification of the corrosion prevention member.

A corrosion prevention member 25 shown in FIG. 6 has two space portions 26 which extend in the air passage direction, whose opposite ends are opened, and which have a generally L-shaped transverse cross section. The corrosion prevention member 25 is formed of a material having a function of sacrificially corroding for the sake of the first heat exchange tubes 2A. The corrosion prevention member 25 is formed by means of bending a single plate. An upper wall 26*a* common between the two space portions 26 is brazed to the lower end of the second header tank 4, and lower walls 26*b* of the space portions 26 are brazed to the projecting portion 2*a* of the upper-end first heat exchange tube 2A.

Figure 7:
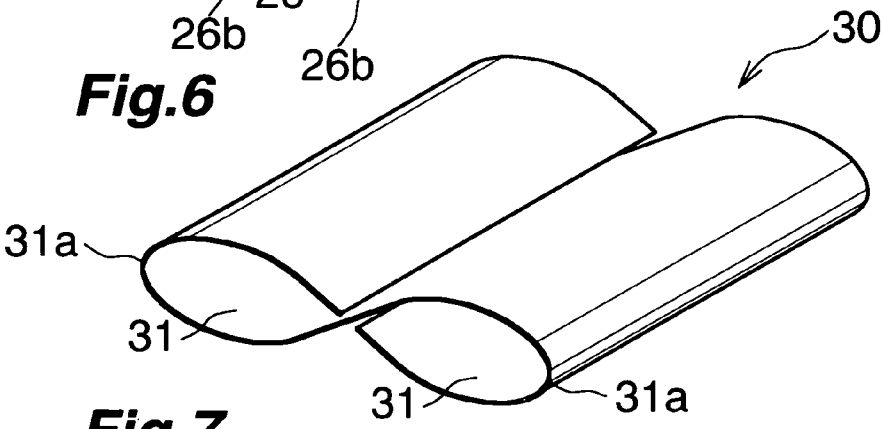
FIG. 7 is a perspective view showing a third modification of the corrosion prevention member.

A corrosion prevention member 30 shown in FIG. 7 has two space portions 31 which extend in the air passage direction, whose opposite ends are opened, and which have a generally elliptical transverse cross section. The corrosion prevention member 30 is formed of a material having a function of sacrificially corroding for the sake of the first heat exchange tubes 2A. The corrosion prevention member 30 is formed by means of bending a single plate. An upper portion of the circumferential wall 31*a* of each space portion 31 is brazed to the lower end of the second header tank 4, and a lower portion of the circumferential wall 31*a* of each space portion 31 is brazed to the projecting portion 2*a* of the upper-end first heat exchange tube 2A.

Figure 8:
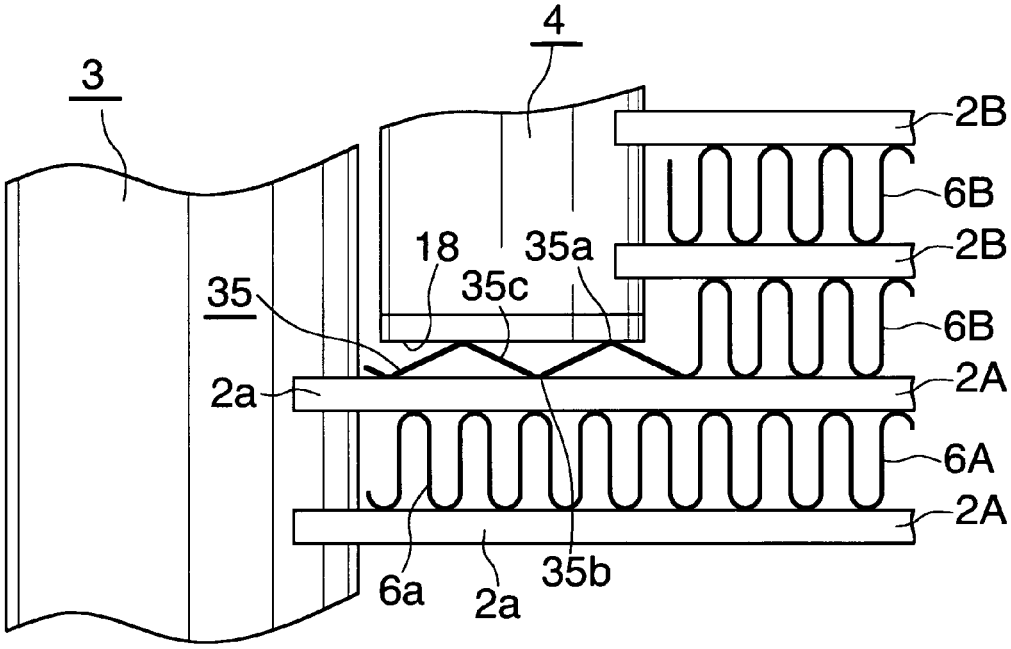
FIG. 8 is a view corresponding to FIG. 3 and showing a fourth modification of the corrosion prevention member.

A corrosion prevention member 35 shown in FIG. 8 is a corrugated member which has crest portions 35*a* extending in the air passage direction, trough portions 35*b* extending in the air passage direction, and connection portions 35*c* connecting the crest portions 35*a* and the trough portions 35*b*, and which is united with the second corrugate fin 6B disposed between the upper-end first heat exchange tube 2A and the lower-end second heat exchange tube 2B. That is, a left-end portion of the second corrugate fin 6B is pulled and extended leftward so as to increase the pitches of adjacent crests and adjacent troughs and decrease the fin height, whereby the corrosion prevention member 35 is formed. The crest portions 35*a* of the corrosion prevention member 35 are brazed to the lower end of the second header tank 4, and the trough portions 35*b* of the corrosion prevention member 35 are brazed to the projecting portion 2*a* of the upper-end first heat exchange tube 2A.

In the case of the corrosion prevention member 20, 25, 30, 35 shown in FIGS. 5 to 8 as well, at the time of manufacture of the condenser 1, the corrosion prevention member 20, 25, 30, 35 is disposed between the projecting portion 2*a* of the upper-end first heat exchange tube 2A and the lower end of the second header tank 4 such that the corrosion prevention member is compressed slightly in the vertical direction, whereby coming off of the corrosion prevention member 20, 25, 30, 35 is prevented during brazing in a furnace.

Figure 9:
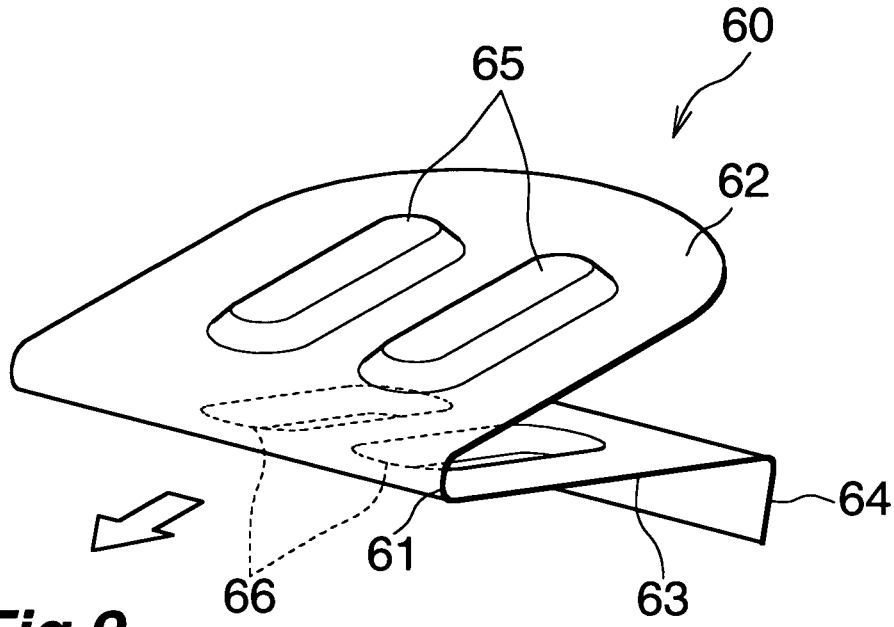
FIG. 9 is a perspective view showing a fifth modification of the corrosion prevention member.

A corrosion prevention member 60 shown in FIG. 9 is a generally V-shaped plate spring which includes an arcuate portion 61, and arm portions 62, 63 extending from the upper and lower ends of the arcuate portion 61. The corrosion prevention member 60 is formed of a material having a function of sacrificially corroding for the sake of the first heat exchange tubes 2A. An engagement portion 64 projects downward from the lower arm portion 63 of the corrosion prevention member 60. The engagement portion 64 comes into engagement with an upstream or downstream side edge portion (in the present embodiment, a downstream edge portion (front edge portion)) of the projecting portion 2*a* of the first heat exchange tubes 2A, when the corrosion prevention member 60 is disposed between the projecting portion 2*a* of the upper-end first heat exchange tube 2A and the lower end of the second header tank 4.

Projection portions 65 project upward from the upper arm portion 62 of the corrosion prevention member 60. The projection portions 65 fit into a recess 4*a* provided on the lower end surface of the second header tank 4, when the corrosion prevention member 60 is disposed between the projecting portion 2*a* of the upper-end first heat exchange tube 2A and the lower end of the second header tank 4. Furthermore, the lower arm portion 63 of the corrosion prevention member 60 has projections 66 which project downward and which have flat end surfaces.

Figure 10:
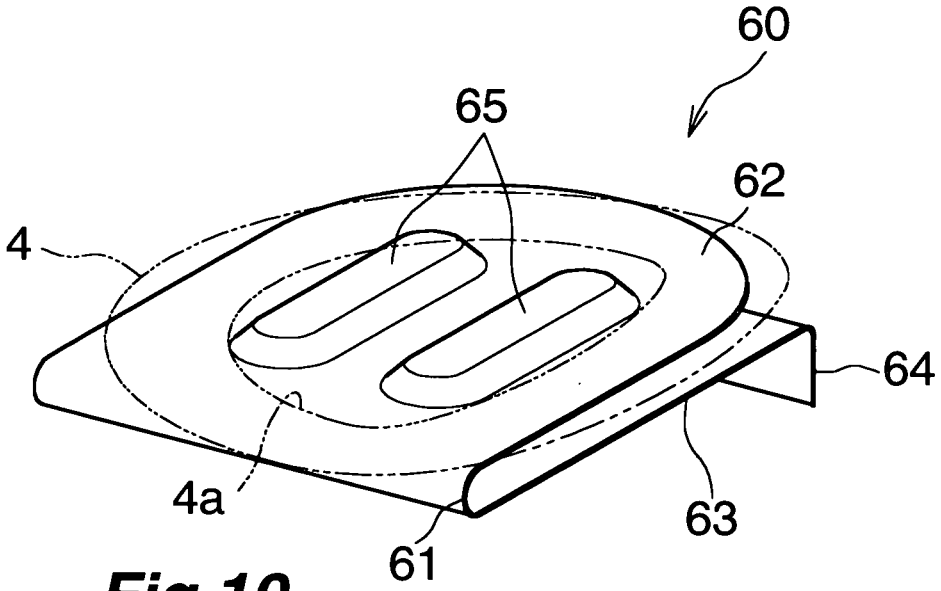
FIG. 10 is a perspective view showing a state in which the corrosion prevention member of FIG. 9 is disposed between a first heat exchange tube and a second header tank.
Figure 11:
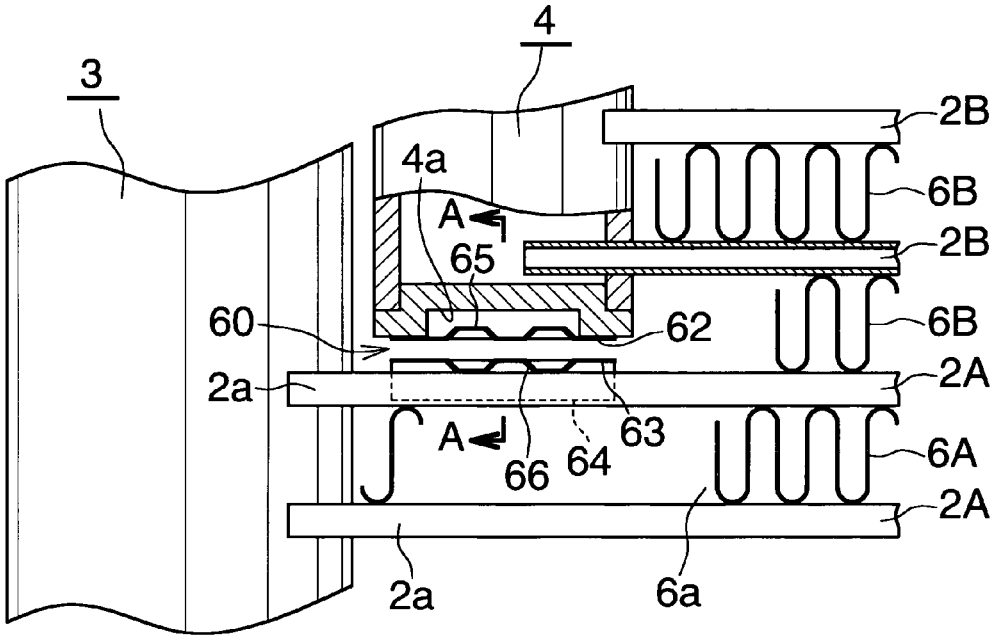
FIG. 11 is a view corresponding to FIG. 3 and showing a condenser including the corrosion prevention member of FIG. 9.
Figure 12:
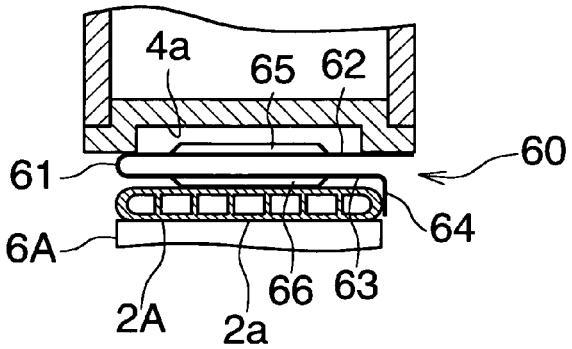
FIG. 12 is a sectional view taken along line A-A of FIG. 11.

When the condenser 1 is manufactured, as shown in FIG. 10, the corrosion prevention member 60 is held such that the arcuate portion 61 is directed rearward, and is elastically deformed such that the two arm portions 62, 63 approach each other. In this state, the corrosion prevention member 60 is inserted, from the front side, between the projecting portion 2*a* of the upper-end first heat exchange tube 2A and the lower end of the second header tank 4, and the engagement portion 64 is brought into engagement with the front edge portion of the projecting portion 2*a* of the upper-end first heat exchange tube 2A. Notably, the corrosion prevention member 60 may be inserted, from the front side, between the projecting portion 2*a* of the upper-end first heat exchange tube 2A and the second header tank 4, without being elastically deformed; i.e., in a state shown in FIG. 9. At that time, as shown in FIGS. 11 and 12, the projections 65 of the upper arm portion 62 fit into the recess 4*a* provided on the lower end surface of the second header tank 4, and the upper arm portion 62 comes into contact with a portion of the lower end surface of the second header tank 4, which portion is located around the recess 4*a*. Furthermore, the projecting end surfaces of the projections 66 of the lower arm portion 63 come into contact with the upper end surface of the projecting portion 2*a* of the upper-end first heat exchange tube 2A. Thus, the corrosion prevention member 60 is provisionally fixed in a state in which the corrosion prevention member 60 is compressedly held between the upper-end first heat exchange tube 2A and the second header tank 4. As a result, coming off of the corrosion prevention member 60 at the time of brazing in a furnace can be prevented.

In this state, the upper arm portion 62 is brazed to the second header tank 4, and the projections 66 of the lower arm portion 63 are brazed to the upper-end first heat exchange tube 2A.

Figure 13:
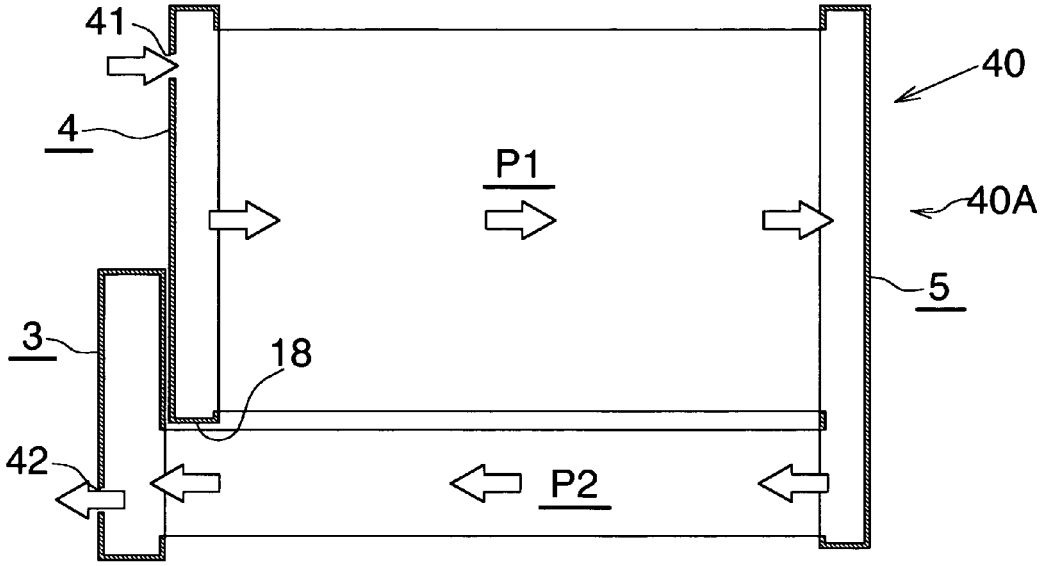
FIG. 13 is a front view schematically showing a second embodiment of the condenser according to the present invention.
Figure 14:
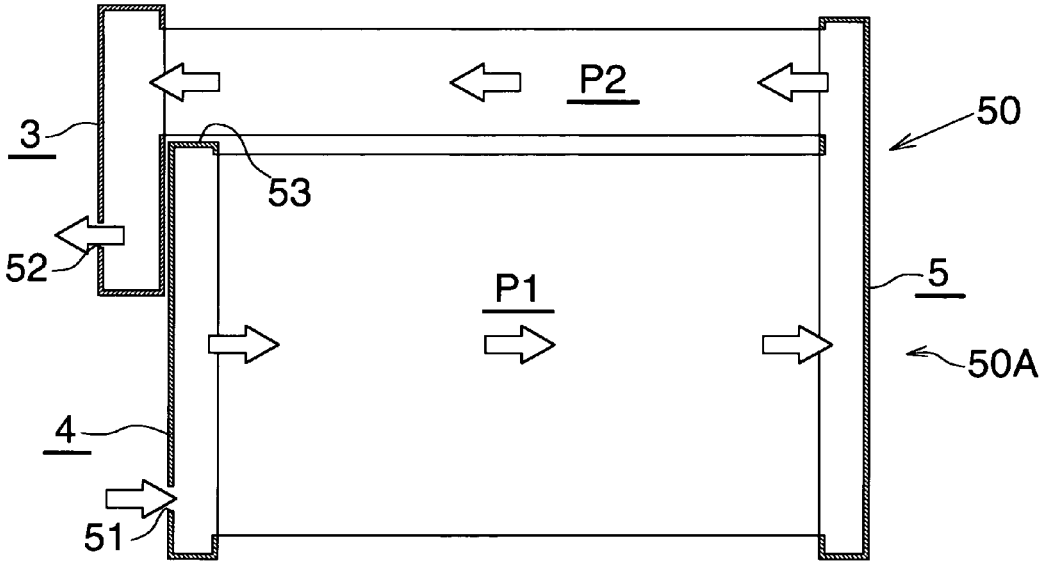
FIG. 14 is a front view schematically showing a third embodiment of the condenser according to the present invention.

FIGS. 13 and 14 show other embodiments of the condenser according to the present invention. Notably, in FIGS. 13 and 14, which schematically show the condenser, the individual heat exchange tubes are omitted, and the corrugate fins, the side plates, the refrigerant inlet member, and the refrigerant outlet member are also omitted.

In the case of a condenser 40 shown in FIG. 13, two heat exchange paths P1, P2 each formed by a plurality of heat exchange tubes 2A, 2B successively arranged in the vertical direction are juxtaposed in the vertical direction. The two heat exchange paths will be referred to as the first and second heat exchange paths P1, P2 from the upper side. The flow direction of refrigerant is the same among all the heat exchange tubes 2A, 2B which form the respective heat exchange paths P1, P2. The flow direction of refrigerant in the heat exchange tubes 2A, 2B which form a certain heat exchange path is opposite the flow direction of refrigerant in the heat exchange tubes 2A, 2B which form another heat exchange path adjacent to the certain heat exchange path.

Left and right end portions of the heat exchange tubes 2B, which form the first heat exchange path P1, are connected to the second header tank 4 and the third header tank 5, respectively, by means of brazing. Left and right end portions of the heat exchange tubes 2A, which form the second heat exchange path P2, are connected to the first header tank 3 and the third header tank 5, respectively, by means of brazing. Therefore, the heat exchange tubes 2A, which form the second heat exchange path P2, are the first heat exchange tubes, and the heat exchange tubes 2B, which form the first heat exchange path P1, are the second heat exchange tubes.

The first through third header tank 3-5, and the first and second heat exchange paths P1, P2 form a condensation section 40A, which condenses refrigerant. The first and second heat exchange paths P1, P2 (i.e., all the heat exchange paths) each serve as a refrigerant condensation path for condensing refrigerant.

A refrigerant inlet 41 is formed at an upper end portion of the second header tank 4, which partially forms the condensation section 40A, and a refrigerant outlet 42 is formed at a lower end portion of the first header tank 3. A refrigerant inlet member (not shown) which communicates with the refrigerant inlet 41 is joined to the second header tank 4, and a refrigerant outlet member (not shown) which communicates with the refrigerant outlet 42 is joined to the first header tank 3.

In the condenser 40 shown in FIG. 13, a corrosion prevention member (not shown) which has a structure shown in any one of FIGS. 4 to 12 and which has a function of sacrificially corroding for the sake of the first heat exchange tubes 2A is disposed in the clearance 18 between the projecting portion 2*a* of the upper-end first heat exchange tube 2A and the lower end of the second header tank 4.

The remaining structure is similar to that of the condenser shown in FIGS. 1 to 3.

In the condenser 40 shown in FIG. 13, gas phase refrigerant of high temperature and high pressure compressed by the compressor flows into the second header tank 4 via the refrigerant inlet member and the refrigerant inlet 41. The gas phase refrigerant is condensed while flowing rightward within the second heat exchange tubes 2B of the first heat exchange path P1, and then flows into the third header tank 5. The refrigerant having flowed into the third header tank 5 is condensed while flowing leftward within the first heat exchange tubes 2A of the second heat exchange path P2, and then flows into the first header tank 3.

The refrigerant having flowed into the first header tank 3 is gas-liquid mixed phase refrigerant. A portion of the gas-liquid mixed phase refrigerant; i.e., liquid-predominant mixed phase refrigerant, remains in a lower region within the first header tank 3 because of gravitational force, and flows out via the refrigerant outlet 42 and the refrigerant outlet member. The refrigerant is then fed to the evaporator via the expansion valve.

Meanwhile, the gas phase component of the gas-liquid mixed phase refrigerant having flowed into the first header tank 3 remains in an upper region within the first header tank 3.

In the case of a condenser 50 shown in FIG. 14, two heat exchange paths P1, P2 each formed by a plurality of heat exchange tubes 2A, 2B successively arranged in the vertical direction are juxtaposed in the vertical direction. The two heat exchange paths will be referred to as the first and second heat exchange paths P1, P2 from the lower side. The flow direction of refrigerant is the same among all the heat exchange tubes 2A, 2B which form the respective heat exchange paths P1, P2. The flow direction of refrigerant in the heat exchange tubes 2A, 2B which form a certain heat exchange path is opposite the flow direction of refrigerant in the heat exchange tubes 2A, 2B which form another heat exchange path adjacent to the certain heat exchange path.

Left and right end portions of the heat exchange tubes 2B, which form the first heat exchange path P1, are connected to the second header tank 4 and the third header tank 5, respectively, by means of brazing. Left and right end portions of the heat exchange tubes 2A, which form the second heat exchange path P2, are connected to the first header tank 3 and the third header tank 5, respectively, by means of brazing. Therefore, the heat exchange tubes 2A, which form the second heat exchange path P2, are the first heat exchange tubes, and the heat exchange tubes 2B, which form the first heat exchange path P1, are the second heat exchange tubes.

The lower end of the first header tank 3, disposed leftward of the second header tank 4, is located below the upper end of the second header tank 4, and the first header tank 3 has a gas-liquid separation function.

The first through third header tank 3-5, and the first and second heat exchange paths P1, P2 form a condensation section 50A, which condenses refrigerant. The first and second heat exchange paths P1, P2 (i.e., all the heat exchange paths) each serve as a refrigerant condensation path for condensing refrigerant.

A refrigerant inlet 51 is formed at a lower end portion of the second header tank 4, which partially forms the condensation section 50A, and a refrigerant outlet 52 is formed at a lower end portion of the first header tank 3. A refrigerant inlet member (not shown) which communicates with the refrigerant inlet 51 is joined to the second header tank 4, and a refrigerant outlet member (not shown) which communicates with the refrigerant outlet 52 is joined to the first header tank 3.

In the condenser 50 shown in FIG. 14, a corrosion prevention member (not shown) which has a structure shown in any one of FIGS. 4 to 12 and which has a function of sacrificially corroding for the sake of the first heat exchange tubes 2A is disposed in the clearance 53 between the projecting portion 2*a* of the lower-end first heat exchange tube 2A and the upper end of the second header tank 4.

The remaining structure is similar to that of the condenser shown in FIGS. 1 to 3.

In the condenser 50 shown in FIG. 14, gas phase refrigerant of high temperature and high pressure compressed by the compressor flows into the second header tank 4 via the refrigerant inlet member and the refrigerant inlet 51. The gas phase refrigerant is condensed while flowing rightward within the second heat exchange tubes 2B of the first heat exchange path P1, and then flows into the third header tank 5. The refrigerant having flowed into the third header tank 5 is condensed while flowing leftward within the first heat exchange tubes 2A of the second heat exchange path P2, and then flows into the first header tank 3. The refrigerant having flowed into the first header tank 3 is gas-liquid mixed phase refrigerant. A portion of the gas-liquid mixed phase refrigerant; i.e., liquid-predominant mixed phase refrigerant, remains in a lower region within the first header tank 3 because of gravitational force, and flows out via the refrigerant outlet 52 and the refrigerant outlet member. The refrigerant is then fed to the evaporator via the expansion valve.

Meanwhile, the gas phase component of the gas-liquid mixed phase refrigerant having flowed into the first header tank 3 remains in an upper region within the first header tank 3.

Notably, in the condensers 40, 50 shown in FIGS. 13 and 14, two or more heat exchange paths each formed by a plurality of second heat exchange tubes 2B successively arranged in the vertical direction may be juxtaposed in the vertical direction between the second header tank 4 and the third header tank 5. In the case where an even number of heat exchange paths are provided between the second header tank 4 and the third header tank 5, a refrigerant inlet is formed at a lower end portion of the third header tank 5, and a proper number of header sections are provided in each of the second header tank 4 and the third header tank 5. In the case where an odd number of heat exchange paths are provided between the second header tank 4 and the third header tank 5, a refrigerant inlet is formed at a lower end portion of the second header tank 4, and a proper number of header sections are provided in each of the second header tank 4 and the third header tank 5.

Notably, in each of the above-described condensers 1, 40, 50, at least one of a desiccant, a gas liquid separation member, and a filter may be disposed in the first header tank 3.

What is claimed is:

1. A condenser comprising a plurality of heat exchange tubes disposed in parallel such that the heat exchange tubes are spaced apart from one another in a vertical direction and extend in a left-right direction; header tanks which extend in the vertical direction and to which left and right end portions of the heat exchange tubes are connected; and fins each disposed between and brazed to heat exchange tubes adjacent to each other in the vertical direction, in which a plurality of heat exchange paths each formed by a plurality of heat exchange tubes successively arranged in the vertical direction are juxtaposed in the vertical direction, wherein first and second header tanks are provided at a left or right end of the condenser, first heat exchange tubes which form at least one heat exchange path located at a lower side being connected to the first header tank, and second heat exchange tubes which form a remaining heat exchange path(s) provided above the heat exchange path formed by the first heat exchange tubes connected to the first header tank being connected to the second header tank;

the first header tank is disposed on the outer side of the second header tank with respect to the left-right direction, has an upper end located above a lower end of the second header tank, and has a function of separating gas and liquid from each other and storing the liquid;

the first heat exchange tubes connected to the first header tank have projecting portions at their ends located on the side toward the first header tank, the projecting portions extending outward, with respect to the left-right direction, of second-header-tank-side end portions of the second heat exchange tubes connected to the second header tank; and a corrosion prevention member having a function of corroding sacrificially for the first heat exchange tubes is disposed in a clearance between the projecting portion of an upper-end first heat exchange tube and the lower end of the second header tank.

2. A condenser comprising a plurality of heat exchange tubes disposed in parallel such that the heat exchange tubes are spaced apart from one another in a vertical direction and extend in a left-right direction; header tanks which extend in the vertical direction and to which left and right end portions of the heat exchange tubes are connected; and fins each disposed between and brazed to heat exchange tubes adjacent to each other in the vertical direction, in which three or more exchange paths each formed by a plurality of heat exchange tubes successively arranged in the vertical direction are juxtaposed in the vertical direction, wherein first and second header tanks are provided at a left or right end of the condenser, first heat exchange tubes which form at least two heat exchange paths successively arranged and including a heat exchange path at a lower end of the condenser being connected to the first header tank, and second heat exchange tubes which form a heat exchange path(s) provided above the heat exchange paths formed by the first heat exchange tubes connected to the first header tank being connected to the second header tank;

the first header tank is disposed on the outer side of the second header tank with respect to the left-right direction, has an upper end located above a lower end of the second header tank, and has a function of separating gas and liquid from each other and storing the liquid;

the first heat exchange tubes connected to the first header tank have projecting portions at their ends located on the side toward the first header tank, the projecting portions extending outward, with respect to the left-right direction, of second-header-tank-side end portions of the second heat exchange tubes connected to the second header tank; and a corrosion prevention member having a function of corroding sacrificially for the first heat exchange tubes is disposed in a clearance between the projecting portion of an upper-end first heat exchange tube and the lower end of the second header tank.

3. A condenser according to claim 2, wherein an upper-end heat exchange path of the heat exchange paths formed by the first heat exchange tubes connected to the first header tank and the heat exchange path(s) formed by the second heat exchange tubes connected to the second header each serve as a refrigerant condensation path for condensing refrigerant, and the heat exchange paths formed by the first heat exchange tubes connected to the first header tank, excluding the upper-end heat exchange path, each serves as a refrigerant supper-cooling path for supper-cooling refrigerant.

4. A condenser according to claim 2, wherein the first heat exchange tubes which form at least two heat exchange paths are connected to the first header tank, and the second heat exchange tubes which form-at least one heat exchange path are connected to the second header tank.

5. A condenser comprising a plurality of heat exchange tubes disposed in parallel such that the heat exchange tubes are spaced apart from one another in a vertical direction and extend in a left-right direction; header tanks which extend in the vertical direction and to which left and right end portions of the heat exchange tubes are connected; and fins each disposed between and brazed to heat exchange tubes adjacent to each other in the vertical direction, in which two or more heat exchange paths each formed by a plurality of heat exchange tubes successively arranged in the vertical direction are juxtaposed in the vertical direction, wherein first and second header tanks are provided at a left or right end of the condenser, first heat exchange tubes which form a heat exchange path at a lower end of the condenser being connected to the first header tank, and second heat exchange tubes which form the heat exchange path(s) other than the heat exchange path at the lower end being connected to the second header tank;

the first header tank is disposed on the outer side of the second header tank with respect to the left-right direction, has an upper end located above a lower end of the second header tank, and has a function of separating gas and liquid from each other and storing the liquid;

the first heat exchange tubes connected to the first header tank have projecting portions at their ends located on the side toward the first header tank, the projecting portions extending outward, with respect to the left-right direction, of second-header-tank-side end portions of the second heat exchange tubes connected to the second header tank; and a corrosion prevention member having a function of corroding sacrificially for the first heat exchange tubes is disposed in a clearance between the projecting portion of the upper-end first heat exchange tube and the lower end of the second header tank.

6. A condenser according to claim 5, wherein each of all the heat exchange paths serves as a refrigerant condensation path for condensing refrigerant.

7. A condenser according to claim 1, wherein the corrosion prevention member is a corrugated member which has crest portions extending in an air passage direction, trough portions extending in the air passage direction, and connection portions connecting the crest portions and the trough portions.

8. A condenser according to claim 7, wherein the corrosion prevention member is integrally provided on a fin disposed between the upper-end first heat exchange tube and a second heat exchange tube adjacent to and located above the upper-end first heat exchange tube.

9. A condenser according to claim 1, wherein the corrosion prevention member is formed by means of bending a single plate, and has a space portion which extends in an air passage direction and whose opposite ends are opened.

10. A condenser according to claim 1, wherein the corrosion prevention member is a generally V-shaped plate spring which includes an arcuate portion and arm portions extending from upper and lower ends of the arcuate portion, and the corrosion prevention member is disposed in a clearance between the projecting portion of the upper-end first heat exchange tube and the lower end of the second header tank in a state in which the corrosion prevention member is elastically deformed such that the two arm portions approach each other.

11. A condenser according to claim 10, wherein the lower arm portion of the corrosion prevention member has an engagement portion which comes into engagement with an upstream or downstream side edge portion of the upper-end first heat exchange tube.

12. A condenser according to claim 10, wherein a recess is formed on a lower end surface of the second header tank, and a projection which fits into the recess is provided on the upper arm portion of the corrosion prevention member.

13. A condenser according to claim 2, wherein the corrosion prevention member is a corrugated member which has crest portions extending in an air passage direction, trough portions extending in the air passage direction, and connection portions connecting the crest portions and the trough portions.

14. A condenser according to claim 5, wherein the corrosion prevention member is a corrugated member which has crest portions extending in an air passage direction, trough portions extending in the air passage direction, and connection portions connecting the crest portions and the trough portions.

15. A condenser according to claim 2, wherein the corrosion prevention member is formed by means of bending a single plate, and has a space portion which extends in an air passage direction and whose opposite ends are opened.

16. A condenser according to claim 5, wherein the corrosion prevention member is formed by means of bending a single plate, and has a space portion which extends in an air passage direction and whose opposite ends are opened.

17. A condenser according to claim 2, wherein the corrosion prevention member is a generally V-shaped plate spring which includes an arcuate portion and arm portions extending from upper and lower ends of the arcuate portion, and the corrosion prevention member is disposed in a clearance between the projecting portion of the upper-end first heat exchange tube and the lower end of the second header tank in a state in which the corrosion prevention member is elastically deformed such that the two arm portions approach each other.

18. A condenser according to claim 5, wherein the corrosion prevention member is a generally V-shaped plate spring which includes an arcuate portion and arm portions extending from upper and lower ends of the arcuate portion, and the corrosion prevention member is disposed in a clearance between the projecting portion of the upper-end first heat exchange tube and the lower end of the second header tank in a state in which the corrosion prevention member is elastically deformed such that the two arm portions approach each other.

* * * * *